US006648173B2

(12) United States Patent
Crawford

(10) Patent No.: US 6,648,173 B2
(45) Date of Patent: Nov. 18, 2003

(54) DISPENSER FOR TAPE STRIP PADS

(75) Inventor: Dennis L. Crawford, Roberts, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 62 days.

(21) Appl. No.: 10/104,130

(22) Filed: Mar. 22, 2002

(65) Prior Publication Data

US 2003/0178437 A1 Sep. 25, 2003

(51) Int. Cl.[7] ..... B65H 1/00
(52) U.S. Cl. ..... 221/63; 206/449
(58) Field of Search ..... 221/33, 45, 46, 221/185, 63, 48; 206/812, 449, 39.7, 39.8

(56) References Cited

U.S. PATENT DOCUMENTS

| | | | | |
|---|---|---|---|---|
| D116,599 | S | 9/1939 | Reinecke | |
| 4,416,392 | A | 11/1983 | Smith | 221/45 |
| 4,562,938 | A | 1/1986 | Loder | 221/46 |
| 4,586,629 | A | 5/1986 | Loder | 221/46 |
| 4,650,706 | A | 3/1987 | Emmel | 428/40 |
| 4,653,666 | A | 3/1987 | Mertens | 221/45 |
| 4,770,320 | A | 9/1988 | Miles et al. | 221/33 |
| 4,895,746 | A | 1/1990 | Mertens | 428/40 |
| 4,928,864 | A | 5/1990 | Walker et al. | 224/162 |
| 5,086,946 | A | 2/1992 | Blackwell et al. | 221/45 |
| 5,299,712 | A | 4/1994 | Carlson et al. | 221/45 |
| D348,484 | S | 7/1994 | Blackwell et al. | D19/69 |
| D348,690 | S | 7/1994 | Samuelson | D19/69 |
| 5,358,141 | A | 10/1994 | Carlson et al. | 221/185 |
| 5,401,547 | A | 3/1995 | Blackwell et al. | 428/40 |
| D359,513 | S | 6/1995 | Carlson | D19/86 |
| 5,518,144 | A | 5/1996 | Samuelson et al. | 221/33 |
| D387,806 | S | 12/1997 | Carlson et al. | D19/86 |
| 5,755,356 | A | 5/1998 | Bastiaens et al. | 221/33 |
| D396,247 | S | 7/1998 | Carlson et al. | |
| D396,492 | S | 7/1998 | Carlson et al. | |
| 5,794,815 | A | 8/1998 | Carlson et al. | |
| 5,964,375 | A | 10/1999 | Carlson et al. | |
| 6,102,247 | A | 8/2000 | Crawford | 221/61 |

FOREIGN PATENT DOCUMENTS

| | | |
|---|---|---|
| WO | WO97/48561 | 12/1997 |

*Primary Examiner*—Kenneth W. Noland
(74) *Attorney, Agent, or Firm*—Carolyn V. Peters

(57) ABSTRACT

A tape strip dispenser defining a retention chamber and having an opening through which the tape strips are dispensed from a W-stacked pad of tape strips retained within the retention chamber. The opening is longitudinally bounded along a first end by a first linear edge, and longitudinally bounded along a second end by a second liner edge, with (i); the first and second linear edges laterally angled relative to a central lateral axis of the retention chamber, and/or (ii) the first and second linear edges independently pivotable about a first and a second lateral axis, respectively.

21 Claims, 3 Drawing Sheets

DISPENSER FOR TAPE STRIP PADS

FIELD OF THE INVENTION

The invention relates to dispensers for tape strip pads.

BACKGROUND OF THE INVENTION

Numerous types of pressure sensitive adhesive tapes capable of connecting or joining two surfaces (e.g., adhering a sheet of paper onto a tabletop) are well known. For example, #810 Scotch™ Magic™ brand transparent tape, manufactured by Minnesota Mining and Manufacturing Company, St. Paul, Minn. is readily available from numerous retail outlets. Such pressure sensitive adhesive tapes, including #810 Scotch™ Magic™ brand transparent tape, are generally available as a continuous roll of tape capable of being conveniently dispensed from any of a number of manually-operated roll-type tape dispensers, such as those disclosed in Walker et al., U.S. Pat. No. 4,928,864 and Reinecke, U.S. Des. Pat. No. 116,599, having a cutting edge located on the dispenser for cutting the tape into strips of the desired length. While effective for quickly and efficiently dispensing most pressure sensitive adhesive tapes, it is difficult to create tape strips of uniform length due to the natural variations in the length of tape unwound from the roll of adhesive tape between cuttings. Hence, such dispensers are not suitable for those situations requiring the quick and efficient dispensing of uniform lengths of pressure sensitive adhesive tape.

It is also known to dispense pressure sensitive adhesive tape, such as Scotch™ Magic™ brand transparent tape, from a stacked pad of tape strips. Such pads of adhesive tape strips are disclosed in Emmel, U.S. Pat. No. 4,650,706, and Mertens, U.S. Pat. No. 4,895,746. Both Emmel and Mertens disclose stacked pads of adhesive tape strips wherein a first end portion of each individual strip is treated so as to provide a nonadhesive end tab (Emmel) or an area of reduced adhesion to an adjacent tape strip (Mertens) at a first end of the pad. The nonadhesive end tab or area of reduced adhesion facilitates initial separation of the first end of an uppermost tape strip from the first end of an immediately underlying tape strip, allowing the uppermost tape strip to be peeled off the pad. While generally effective for dispensing uniform lengths of pressure sensitive adhesive tape, such pads are somewhat cumbersome to use and are not well suited for use in those situations where only one hand is available for dispensing the tape, such as gift-wrapping.

Post-it® brand notes and Post-it® brand flags, available from Minnesota Mining and Manufacturing Company of St. Paul, Minn., require a coating of releasable pressure sensitive adhesive only along one end of the substrate, and can therefore be conveniently dispensed from a container by alternating the adhesive end of the stacked sheets/flags between opposed first and second ends of the stack (e.g., forming a Z-stack of sheets). Such a stack of Post-it® brand flags and associated shuttling dispenser is disclosed in U.S. Pat. No. 4,770,320 to Miles et al. Similarly, a pad of W-stacked sheets and associated dispensers are disclosed in U.S. Pat. Nos. 4,416,392 to Smith, 4,562,938 to Loder, 4,586,629 to Loder, and 4,653,666 to Mertens. This alternating style of stacking the sheets/flags is effective because the sheets/flags are adhesively bonded together with a relatively weak repositionable pressure sensitive adhesive on only one end of the sheet/flag. Such sheets are not suitable for joining or connecting surfaces together because of the relatively small percentages of such sheets coated with adhesive and the relatively weak nature of the pressure sensitive adhesive used with such sheets/flags.

A significant advance in the construction and dispensing of pads of adhesive tape strips is disclosed in Blackwell et al., U.S. Pat. No. 5,401,547. Blackwell et al. discloses a pad of superimposed adhesive tape strips wherein the adhesive layer of each tape strip is releasably adhered to an adjacent tape strip at a first adhesion level at a first end and a second adhesion level at a second end (i.e., differential release), and sequential tape strips are longitudinally reversed so as to align the first end of each tape strip with the second end of an immediately overlaying and an immediately underlying tape strip. A preferred manner of achieving such differential release disclosed by Blackwell et al. is to coat the entire surface area of a first major surface of each strip with a pressure sensitive adhesive and coat the second end portion of the second major surface of each tape strip with a low adhesion backsize. Such an alternately stacked pad of differential release tape strips can be conveniently dispensed from an associated dispenser with a single hand while maintaining a continuous coating of an aggressive pressure sensitive adhesive on the substrate.

While constituting a significant improvement, the pads disclosed by Blackwell et al. comply with narrow quality control standards in order to achieve the sliding action required between adjacent tape strips for proper dispensing while preventing fanning of the stacked strips (i.e., preventing the tape strips from accidentally and unintentionally sliding relative to one another before each strip is dispensed). Furthermore, as described in Blackwell et al., when the necessary differential release requirement is achieved by the application of a premium low adhesion backsize on one end of the tape strips and a basic adhesion backsize on the other end, that portion of the tape strip coated with the premium low adhesion backsize does not consistently maintain any written indicia.

A variety of dispensers have been developed for dispensing individual tape strips from such pads of adhesive tape strips. Exemplary dispensers are disclosed in U.S. Pat. Nos. 5,086,946; 5,518,144; 5,299,712; 5,358,141; 5,755,356; Des. 348,690; Des. 348,484; Des. 359,513; Des. 387,806 and PCT Publication WO 97/48561.

Unfortunately, the tape strip pad dispensers and dispensing techniques taught by Blackwell et al. and others are not suited for dispensing individual tape strips from tape strip pads wherein the tape strips are attached by high adhesion (unwind) forces. Dispensing of such high adhesion tape strips from a tape strip pad requires a high peel force to dispense the individual tape strips, which consumers find objectionable, and tends to cause the individual tape strips to "walk-off" the pad during dispensing.

Accordingly, a substantial need exists for a dispenser capable of easily and reliably dispensing high adhesion tape strips from tape strips pads with the same convenience and reliability of dispensing low adhesion tape strips from tape strip pads as provided by Blackwell et al.

SUMMARY OF THE INVENTION

A first embodiment of the invention is a tape strip dispenser having an angled opening through which the tape strips are dispensed. A first aspect of the first embodiment comprises a housing wherein (a) the housing has a top, a longitudinally centralized opening through the top, and an internal retention chamber accessible through the opening, (b) the retention chamber defines a central lateral axis, and (c) the longitudinally centralized opening has longitudinally spaced first and second linear boundaries which are laterally angled relative to the central lateral axis. The first and second linear boundaries are preferably (i) parallel to one another, and/or (ii) independently laterally angled relative to the central lateral axis at an angle of between about 10° to about 30°.

A second aspect of the first embodiment comprises a housing wherein (a) the housing has transversely spaced top and bottom surfaces, longitudinally spaced first and second ends, and laterally spaced first and second sides, (b) the housing defines a retention chamber and a longitudinally centralized opening through the top, (c) the retention chamber defines a longitudinal central axis and a lateral central axis, and (d) the opening is longitudinally bounded along a first end by a first linear edge, and longitudinally bounded along a second end by a second liner edge, wherein the first and second linear edges are laterally angled relative to the central lateral axis. The first and second linear edges are preferably (i) parallel to one another, and/or (ii) independently laterally angled relative to the central lateral axis at an angle of between about 10° to about 30°.

A second embodiment of the invention is an article of commerce, which includes a tape strip dispenser, and a tape strip pad wherein the dispenser has an angled opening through which the tape strips are dispensed. A first aspect of the second embodiment of the invention includes (a) a dispenser having a top, a longitudinally centralized opening through the top, and an internal retention chamber accessible through the opening, and (b) a tape strip pad retained within the retention chamber and defining a central lateral axis, wherein (c) the longitudinally centralized opening has longitudinally spaced first and second linear boundaries which are laterally angled relative to the central lateral axis of the tape strip pad retained within the retention chamber. The first and. second linear boundaries are preferably (i) parallel to one another, and/or (ii) independently laterally angled relative to the central lateral axis at an angle of between about 10° to about 30°.

A second aspect of the second embodiment of the invention includes (a) a dispenser which includes at least (i) transversely spaced top and bottom surfaces, (ii) longitudinally spaced first and second ends, (iii) laterally spaced first and second sides, (iv) a retention chamber, and (v) a longitudinally centralized opening through the top with the opening longitudinally bounded along a first end by a first linear edge, and longitudinally bounded along a second end by a second liner edge, and (b) a tape strip pad retained within the retention chamber and defining a central lateral axis, wherein (c) the first and second linear edges are laterally angled relative to the central lateral axis of the tape strip pad retained within the retention chamber. The first and second linear edges are preferably (i) parallel to one another, and/or (ii) independently laterally angled relative to the central lateral axis at an angle of between about 10° to about 30°.

A third embodiment of the invention is a tape strip dispenser having pivotable linear edges defining the opening through which the tape strips are dispensed. A first aspect of the third embodiment comprises a housing wherein (a) the housing includes at least (i) transversely spaced top and bottom surfaces, (ii) longitudinally spaced first and second ends, and (iii) laterally spaced first and second sides, (b) the housing defines (i) a retention chamber, and (ii) a longitudinally centralized opening through the top with the opening longitudinally bounded along a first end by a first linear edge, and longitudinally bounded along a second end by a second liner edge, wherein (c) the first and second linear edges are independently pivotable about a first and a second lateral axis, respectively.

A fourth embodiment of the invention is a method for angularly dispensing an overlying tape strip from a W-stacked pad of differential release tape strips. The fourth embodiment of the invention includes the sequential steps of (1) pulling the second longitudinal end of an overlying tape strip away from a tape strip pad so as to effect peeling of the overlying tape strip from an intermediate tape strip in a progressive fashion from the second longitudinal end of the overlying tape strip towards the first longitudinal end of the overlying tape strip, (2) contacting the overlying tape strip so as to consistently cause the overlying tape strip to release from the intermediate tape strip along a line of departure which is laterally angled relative to the central lateral axis of the pad prior to complete separation of the overlying tape strip from the intermediate tape strip and prior to release of a second longitudinal end section of the intermediate tape strip from an underlying tape strip, and (3) continuing to pull the overlying tape strip away from the pad to sequentially effect (i) release of the second longitudinal end section of the intermediate tape strip from the underlying tape strip, and (ii) complete separation of the overlying tape strip from the intermediate tape strip. The line of departure is preferably laterally angled relative to the central lateral axis of the pad at an angle of between about 10° to about 30°.

A fifth embodiment of the invention is a method for dispensing an overlying tape strip from a W-stacked pad of differential release tape strips with pivoting of the contact edges. The fifth embodiment of the invention includes the sequential steps of (1) pulling the second longitudinal end of an overlying tape strip away from a tape strip pad so as to effect peeling of the overlying tape strip from an intermediate tape strip in a progressive fashion from the second longitudinal end of the overlying tape strip towards the first longitudinal end of the overlying tape strip, (2) contacting the overlying tape strip across the lateral width of the overlying tape strip with a linear edge prior to complete separation of the overlying tape strip from the intermediate tape strip and prior to release of a second longitudinal end section of the intermediate tape strip from the underlying tape strip, and (3) continuing to pull the overlying tape strip away from the pad to sequentially effect (i) release of the second longitudinal end section of the intermediate tape strip from the underlying tape strip, wherein (4) the contacted liner edge pivots about a corresponding lateral axis away from the pad in concurrence with movement of the overlying tape strip during at least a portion of the continued pulling of the overlying tape strip away from the pad to effect release of the second longitudinal end section of the intermediate tape strip from the underlying tape strip. The contacted liner edge preferably pivots in concurrence with movement of the overlying tape strip until the second longitudinal end section of the intermediate tape strip releases from the underlying tape strip.

DETAILED DESCRIPTION OF THE INVENTION INCLUDING A BEST MODE

DEFINITIONS

Figure 1:
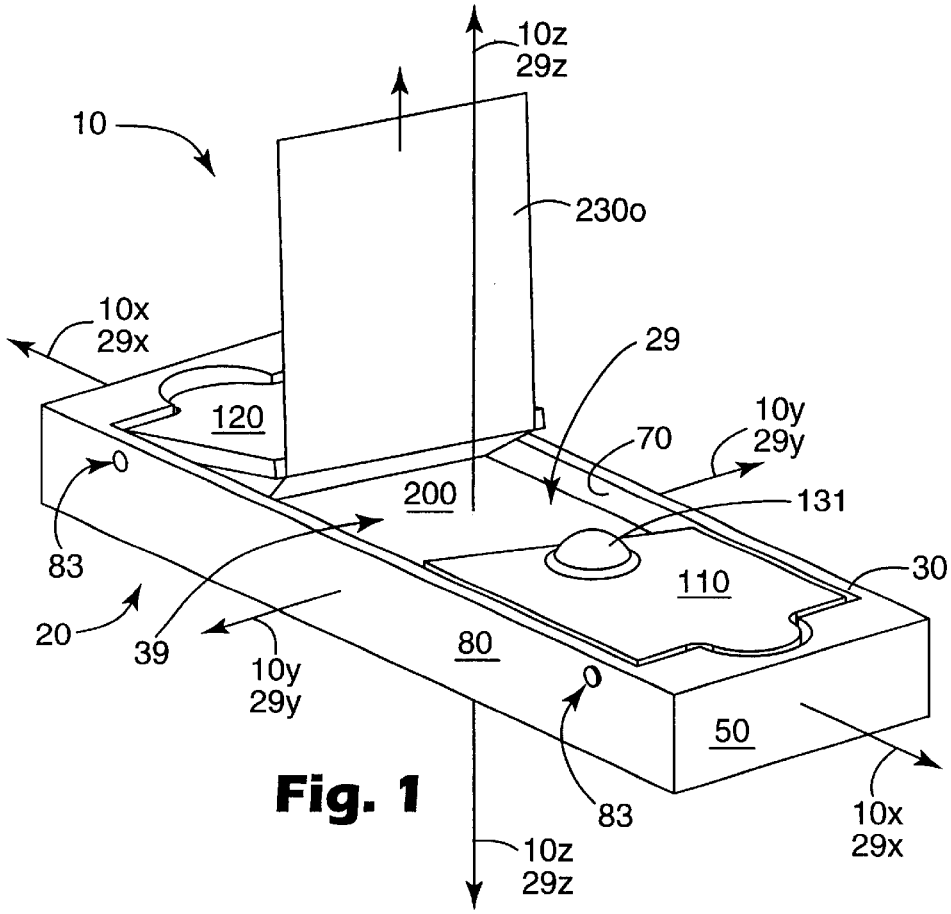
FIG. 1 is a perspective view of one embodiment of the article of commerce with one embodiment of the dispenser containing a tape strip pad.
Figure 2:
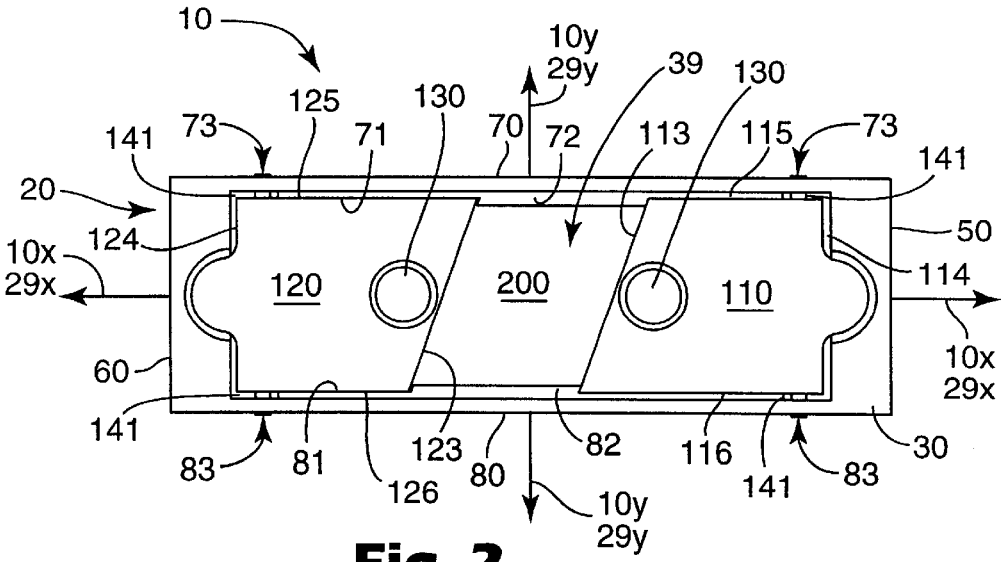
FIG. 2 is a top view of the article of commerce of FIG. 1.

As utilized herein, including the claims, the phrase "line of departure," refers to the line between adjacent overlying and intermediate adhesive tape strips along which the strips lose contact with one another as the overlying tape strip is peeled from the intermediate tape strip. The line of departure progresses longitudinally along the adhesive tape strips as the overlying tape strip is peeled from the intermediate tape strip.

As utilized herein, including the claims, the phrase "release force," refers to the force required to achieve release of a tape strip from an immediately adjacent tape strip measured in accordance with ASTM D3811.

As utilized herein, including the claims, the phrase "differential release" when used to characterize an adhesive tape strip, means that the longitudinal end portions of the adhesive tape strip adhere to an underlying tape strip at different adhesion levels, such that the force required to separate sequential tape strips (i.e., release force) is greater at one longitudinal end than at the other longitudinal end.

As utilized herein, including the claims, the term "tail off" when used to describe the defective dispensing of tape strips from a tape strip pad, refers to those situations where an overlaying tape strip separates from an intermediate tape strip without lifting the area of differential release between the intermediate tape strip and an underlying tape strip a distance sufficient to permit the intermediate tape strip to engage a dispenser and remain spaced from the underlying tape strip so as to facilitate subsequent dispensing of the intermediate tape strip. Tail off includes both the phenomenon known as "walk off" (i.e., the overlaying tape strip separates from an intermediate tape strip without lifting an area of the intermediate tape strip) and the phenomenon known as "fall back" (i.e., the area of the intermediate tape strip adhered to an underlying tape strip at a differential release is separated from the underlying tape strip during dispensing of the overlying tape strip, but does not separate far enough to prevent the intermediate tape strip from returning to the pad and reengaging the underlying tape strip when the overlaying tape strip is separated from the intermediate tape strip). An intermediate tape strip subjected to "tail off" is difficult to dispense because a portion of the "tailed off" tape strip is not properly presented for dispensing and a user must attempt to initiate separation of the "tailed off" tape strip from the pad by picking at the edge the "tailed off" tape strip.

As utilized herein, including the claims, a "W-stacked pad of adhesive tape strips" refers to a pad of superimposed differential release adhesive tape strips with the adhesive layer of each tape strip releasably adhered to an adjacent tape strip and sequential tape strips longitudinally reversed so as to align the first end of each tape strip with the second end of an immediately overlaying and an immediately underlying tape strip, whereby the adhesive layer of each tape strip adheres the second end portion of each tape strip to the first end portion of an adjacent tape strip at a second adhesion level and adheres the first end portion of each tape strip to the second end portion of an adjacent tape strip at a first adhesion level.

Construction

Individual Tape Strips

The adhesive tape strip pad 200 is comprised of a plurality of superimposed individual tape strips 230. The individual tape strips 230 have a first longitudinal end 231, a second longitudinal end 232, a first lateral side 233, a second lateral side 234, a first major surface 235, and a second major surface 236. The individual tape strips 230 are constructed from a flexible substrate 230*s*, such as paper, polyethylene, polypropylene, polyethylene terephthalate, etc. The first major surface 235 of each tape strip 230 is coated with a low adhesion backsize 250 to facilitate separation of the superimposed individual strips 230. The second major surface 236 of each tape strip 230 is coated with an adhesive 240, such as a repositionable adhesive or a permanent pressure sensitive adhesive.

Pad of Adhesive Tape Strips

The pad 200 of adhesive tape strips 230 defines a longitudinal axis 200*x* and a lateral axis 200*y*, and has a first longitudinal end 201 and a second longitudinal end 202.

The pad 200 is formed from any desired number of individual adhesive tape strips 230, preferably between about 10 and 120 tape strips 230, by adhering the second major surface 236 of each individual tape strip 230 to the first major surface 235 of an immediately underlying tape strip 230*u*. The first major surface 235 of the tape strips 230 is coated with a low adhesion backsize 250 with a first area 251 completely coated or pattern coated in a first pattern with low adhesion backsize 250 and a second area 252 pattern coated in a second pattern with low adhesion backsize 250. The second pattern coating permits a higher adhesion strength than the complete or first pattern coating (i.e., the pattern of the second pattern coating covers less surface area than the pattern of the second pattern coating). The individual adhesive tape strips 230 are then stacked with successive strips 230 in the pad 200 positioned with the high adhesion pattern coated area 251 of each strip 230 alternating between the first 201 and second 202 longitudinal edges of the pad 200. The difference in adhesive strength between the high adhesion pattern coated area 252 and the low adhesion pattern coated area 252 is selected so that an intermediate tape strip 230*i* will delaminate from the low adhesion coated area 251 of an immediately underlying tape strip 230*u* when an immediately overlying strip 230*o* is peeled from the pad 200.

The change in adhesive strength can also be achieved by several other mechanisms, including specifically, but not exclusively, (i) coating only a portion of the first major surface 235 of each tape strip 230 with low adhesion backsize 250, (ii) coating only a portion of the second major surface 236 of each tape strip 230 with adhesive 240, and (iii) pattern coating the adhesive 240 onto the second major surface 236 of each tape strip 230 in a fashion similar to the pattern coating of the low adhesion backsize 250 described above. Exemplary alternative embodiments are disclosed in International Publication WO 00/29224.

For purposes of clarity and without intending to be unduly limited thereby, a group of any three sequentially stacked tape strips 230 in the pad 200 shall hereinafter be referenced as a "dispensing set" of tape strips 230 with the tape strip 230 having an exterior facing first major surface 235 (i.e., the surface coated with low adhesion backsize 250) referenced as the overlaying tape strip 230*o*, the tape strip 230 having an exterior facing second major surface 236 (i.e., the surface coated with adhesive 240) referenced as the underlying tape strip 230*u*, and the tape strip 230 sandwiched between the overlaying 230*o* and the underlying 230*u* tape strips referenced as the intermediate tape strip 230*i*.

Dispenser

The dispenser 10 can be constructed as a shuttling or non-shuttling type dispenser 10. Construction of shuttling type dispensers is generally disclosed in U.S. Pat. Nos. 5,086,946 issued to Blackwell et al. and U.S. Pat. No. 5,299,712 issued to Carlson et al. Construction of non-shuttling type dispensers is generally disclosed in U.S. Pat. Nos. 5,518,144 issued to Samuelson et al. and U.S. Pat. No. 6,102,247 issued to Crawford.

Figure 3:
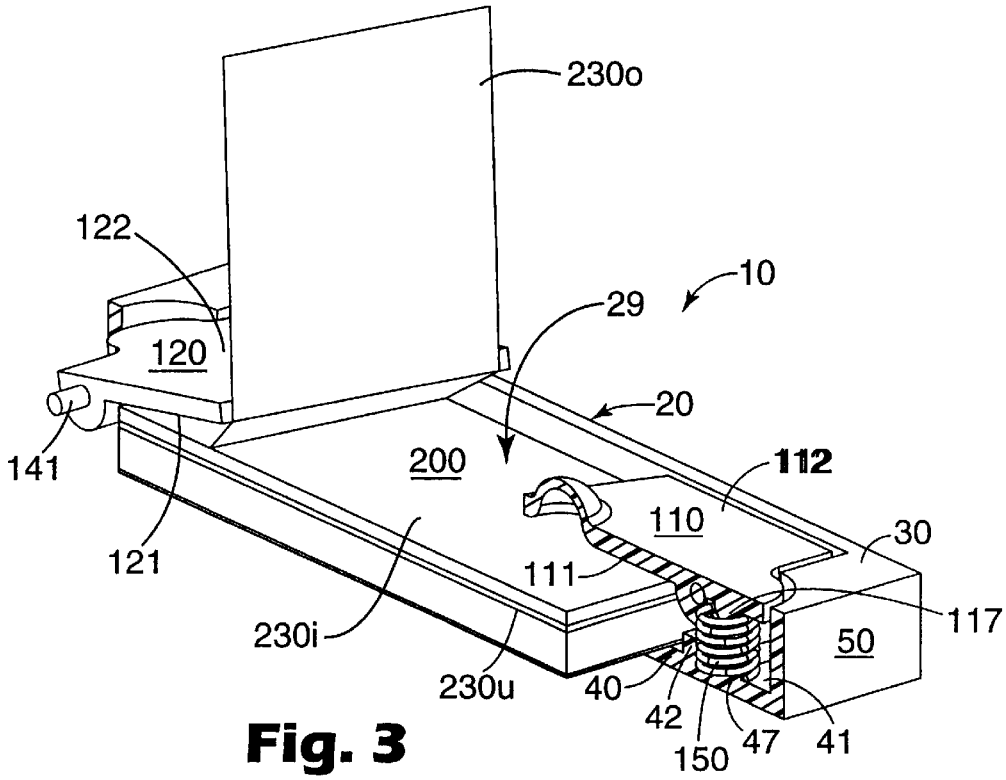
FIG. 3 is a perspective view of the article of commerce of FIG. 1 with a portion of the dispenser removed to facilitate viewing of internal components.
Figure 4:
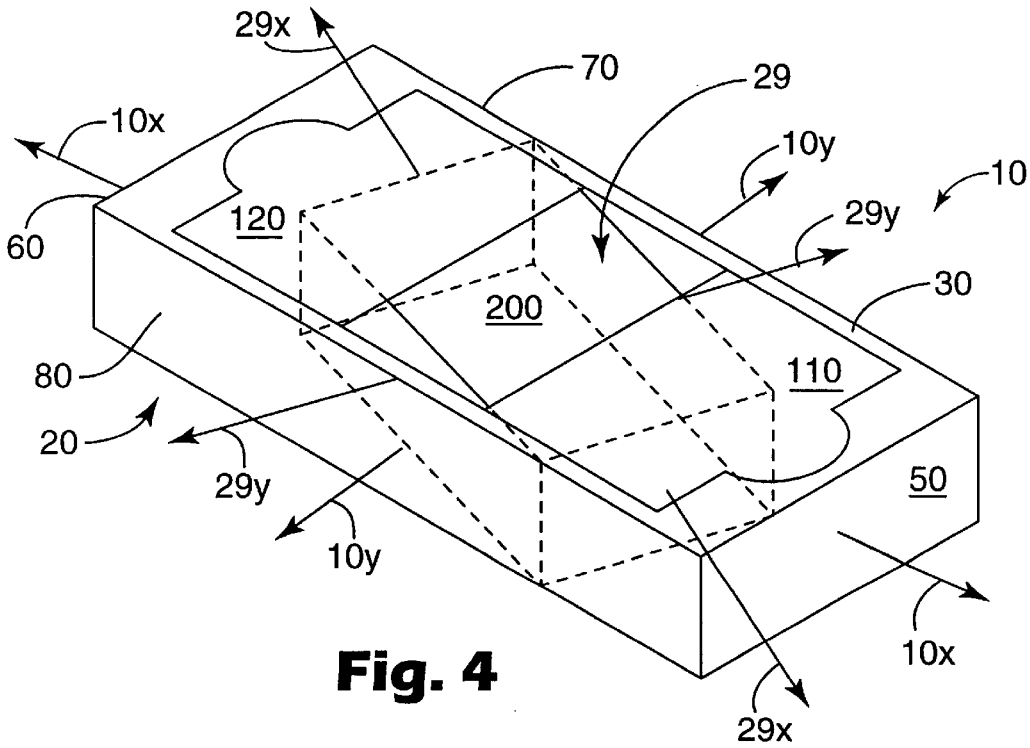
FIG. 4 is a perspective view of an alternative embodiment of the article of commerce with an alternative embodiment of the dispenser containing a tape strip pad.
Figure 5:
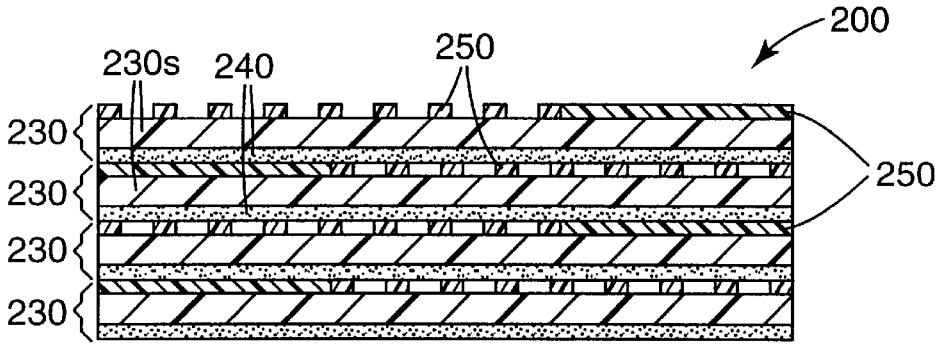
FIG. 5 is an exaggerated side view of a tape strip pad.
Figure 6:
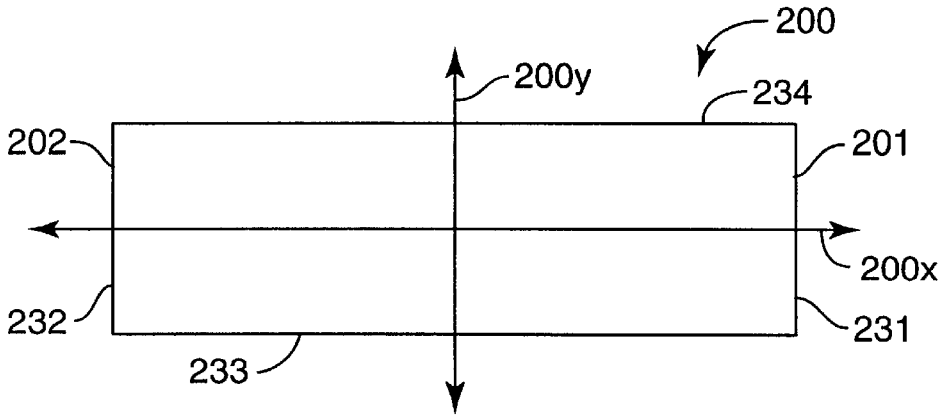
FIG. 6 is a top view of the tape strip pad shown in FIG. 5.
Figure 7:
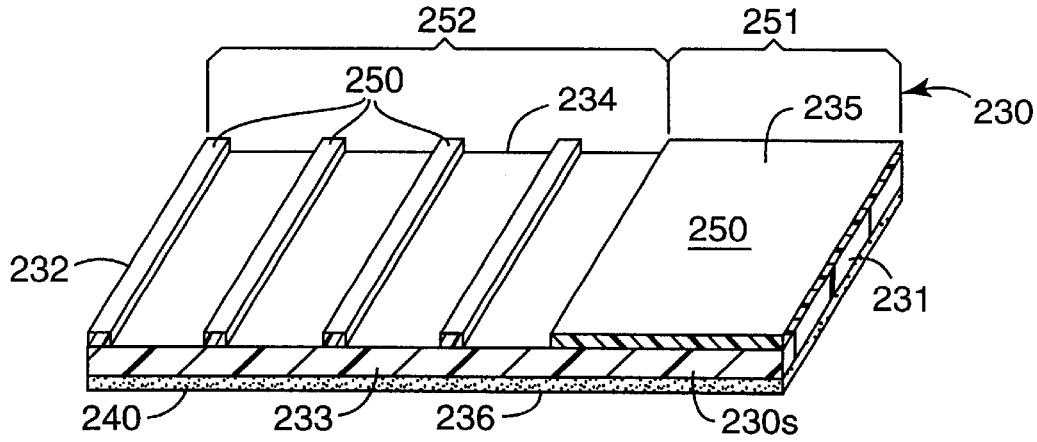
FIG. 7 is an exaggerated perspective view of a single tape strip shown in FIG. 5.

The dispenser 10 includes a housing 20 and a pair of lever arms 110 and 120 which define a longitudinal axis 10*x*, a lateral axis 10*y* and a transverse axis 10*z*. The housing 20 has a top 30, bottom 40, first end wall 50, second end wall 60, first side wall 70, and second side wall 80. The housing 20 defines a retention chamber 29 configured and arranged to hold a tape strip pad 200 in position for dispensing individual tape strips 230 from the tape strip pad 200 through an opening 39 in the top 30 of the dispenser 10 between a first lever arm 110 and a second lever arm 120. The retention chamber defines a longitudinal axis 29*x*, a lateral axis 29*y* and a transverse axis 290*z*. As shown in FIGS. 1 and 4, the dispenser 10 and chamber 29 may be configured and arranged relative to each other such that the corresponding dispenser and chamber axies 10*x*,29*x*, 10*y*,29*y* and 10*z*,29*z* are superimposed upon one another (FIG. 1) or one or more of the corresponding dispenser and chamber axies 10*x*,29*x*, 10*y*,29*y* and 10*z*,29*z* are angled relative to one another (FIG. 3). As shown in FIG. 3, when the dispenser 10 is a non-shuttling type dispenser 10, the retention chamber 29 is sized relative to the tape strip pad 200 to be dispensed from the dispenser 10 to prevent any appreciable longitudinal movement of the tape strip pad 200 during dispensing, such as through the incorporation of a transversely projecting, laterally extending flange 42 at each longitudinal end of the retention chamber 29.

The first lever arm 110 includes an interior major surface 111, an exterior major surface 112, a distal end 113, a proximal end 114, a first side 115 and a second side 116. Similarly, the second lever arm 120 includes an interior major surface 121, an exterior major surface 122, a distal end 123, a proximal end 124, a first side 125 and a second side 126.

The first lever arm 110 is pivotably attached to the housing 20 proximate the first end 50 of the housing 20 about a lateral pivoting axis (unnumbered) for pivoting as between a lowered rest position and a raised dispensing position. The second lever arm 120 is pivotably attached to the housing 20 proximate the second end 60 of the housing 20 about a lateral pivoting axis (unnumbered) for similarly pivoting as between a lowered rest position and a raised dispensing position.

The lever arms 110 and 120 may be pivotably connected to the housing 20 by any suitable means including pin hinges and living hinges. As shown in FIGS. 1 and 3, a suitable means for pivotably connecting the lever arms 110 and 120 to the housing 20 comprises a pair of laterally aligned pins 141 extending from both sides 115, 116 and 125, 126 of each lever arm 110 and 120, with the pins 141 rotatably inserted within corresponding holes 73 and 83 in the first and second side walls 70 and 80 of the housing 20, respectively.

The distal ends 113 and 123 of the first and second lever arms 110 and 120 are longitudinally spaced a distance of between about 1 cm to about 4 cm from the corresponding first and second lateral axis (unnumbered). A distance of less than about 1 cm generally does not provide an adequate distance of travel for allowing the distal ends 113 and 123 to pivot in concurrence with movement of the overlying tape strip 230*o* during continued pulling of the overlying tape strip 230*o* away from the pad 200 until the second longitudinal end section (unnumbered) of the intermediate tape strip 230*i* releases from the underlying tape strip 230*u*. A distance of greater than about 2 cm generally results in an unnecessary increase in the size of the dispenser 10.

The lever arms 110 and 120 are preferably biased towards the lowered rest position by means of a suitable biasing means, such as a compression spring, expansion spring, leaf spring, elastic band, etc. As shown in FIG. 3, a preferred biasing means is an expansion spring 150 longitudinally positioned between the lateral pivoting axis (unnumbered) and the proximal end 114 and 124 of each lever arm 110 and 120, and transversely positioned between the interior surface 111 and 121 of the lever arms 110 and 120 and the interior major surface 41 of the bottom 40 of the housing 20. The spring 150 may be retained in position by a pair of transversely aligned fingers 47 and 117 wherein (i) the first finger 47 transversely projects from the interior major surface 41 of the bottom 40 of the housing 20 towards the corresponding lever arm 110 or 120, and (ii) the second finger 117 transversely projects from the interior major surface 111 or 121 of the corresponding lever arm 110 or 120 towards the bottom 40 of the housing 20.

The housing 20 preferably includes shoulders 72 and 82 along both the interior major surface 71 and 81 of each side wall 70 and 80 proximate the top 30 of the housing 20, for contacting the first side 115 and second side 116 of the first lever arm 110 and the first side 125 and second side 126 of the second lever arm 120 when the lever arms 110 and 120 are biased into the lowered rest position.

Pivoting of a lever arm 110 or 120 toward the raised dispensing position is inherently achieved during the dispensing of each overlying tape strip 230*o* from a tape strip pad 200 retained within the retention chamber 29 defined by the housing 20. During dispensing of each overlying tape strip 230*o* the overlying tape strip 230o contacts the distal end 113 or 123 of one of the lever arms 110 or 120 as the overlying tape strip 230*o* is peeled from the tape pad 200 and pulled upward from the retention chamber 29. The distal ends 113 and 123 of the lever arms 110 and 120 are configured and arranged and/or provided with a surface texture such that continued upward movement of the overlying tape strip 230*o* after initial contact with the distal end 113 or 123 of a lever arm 110 or 120 causes the lever arm 110 or 120 to pivot upward against the force of the biasing spring 150 towards the dispensing position in concurrence with upward movement of the overlying tape strip 230*o*. Such pivoting of the lever arm 110 or 120 towards the dispensing position in concurrence with upward movement of the overlying tape strip 230*o* reduces or eliminates the drag force associated with sliding of the overlying tape strip 230*o* against a static edge, and thereby reduces peak dispensing forces associated with dispensing of the overlying tape strip 230*o*. Such pivoting also improves reliability and consistency of dispensing, particularly as to the reliability of achieving proper separation of the second end 232 of the intermediate tape strip 230*i* from the first end 231 of the underlying tape strip 230*u* during dispensing of the overlying tape strip 230*o*. Such improvements in dispensing permit the manufacture of tape strip pads 200 with a greater range of adhesive tape strip 230 sizes and shapes and a greater range of adhesives 240 and low adhesion backsizes 250.

The distal ends 113 and 123 of the lever arms 110 and 120 provide a straight edge, which is laterally angled relative to the central lateral axis 29*x* defined by the retention chamber 29. The distal ends 113 and 123 are preferably independently angled between about 10° to about 30° in either direction relative to the central lateral axis 29*x* defined by the retention chamber 29. Such lateral angling of the distal ends 113 and 123 of the lever arms 110 and 120 causes the overlying tape strip 230*o* to release from the intermediate tape strip 230*i* along a line of departure (unnumbered) angled relative to the central lateral axis 200*y* of the tape strip pad 200 retained within the retention chamber 29. Such angled dispensing achieves a reduction in the peak dispensing forces associated with release of the intermediate tape strip 230*i* from the underlying tape strip 230*u* during dispensing of the overlying tape strip 230*o* and thereby permit manufacture of tape strip pads 200 with a greater range of adhesive tape strip 230 sizes and shapes and a greater range of adhesives 240 and low adhesion backsizes 250.

The distal ends 113 and 123 of the lever arms 110 and 120 are preferably configured and arranged on the dispenser 10 such that during dispensing of an overlying tape strip 230*o* the overlying tape strip 230*o* will contact a distal end 113 or 123 and form a laterally angled line of departure with a longitudinal length, measured along a central longitudinal axis not shown) of the pad 200, of at least 1 cm, preferably at least 2 cm, of the overlying tape strip 230*o* still adhered to the intermediate tape strip 230*i*.

Method of Manufacture

The housing 20 and lever arms 110 and 120 may be constructed from a number of different suitable materials including specifically, but not exclusively thermoplastics such as polystyrene, polyethylene and polypropylene and thermosets such as polyethylene terephthalate and polyvinyl chloride.

Process of Using

A tape strip 230 may be dispensed from the dispenser 10 by sequentially (i) pulling on the free end (unnumbered) of the overlying tape strip 230*o* extending through the opening 39 in the top 30 of the housing 20 until the overlying tape strip 230*o* is completely detached from the intermediate tape strip 230*i*, (ii) allowing the overlying tape strip 230*o* to contact the distal end 113 or 123 of a lever arm 110 or 120 and thereby (a) cause the overlying tape strip 230*o* to release from the intermediate tape strip 230*i* along a line of departure which is angled relative to the central lateral axis 200*y* of the tape strip pad 200, and (b) pivot the lever arm 110 or 120 upward from the rest position along with movement of the overlying tape strip 230*o* so as to reduce or eliminate any drag between the overlying tape strip 230*o* and the distal end 113 or 123 of the lever arm 110 or 120, (iii) permitting the free end (unnumbered) of the intermediate tape strip 230*i* (now the overlying tape strip) extending through the opening 39 to fall back into contact with a bump 130 extending transversely from the exterior major surface 112 and 122 of each lever arm 110 and 120 proximate the distal end 113 and 123 of each lever arm 110 and 120, and (v) repeating steps (i) through (iii) as necessary to dispense the desired number of individual tape strips 230.

We claim:

1. A tape strip dispenser comprising a housing, wherein:

(a) the housing has a top, a longitudinally centralized opening through the top, and an internal retention chamber accessible through the opening;

(b) the retention chamber defines a central lateral axis; and (c) the longitudinally centralized opening has longitudinally spaced first and second linear boundaries, which are laterally angled relative to the central lateral axis.

2. The dispenser of claim 1 wherein the first and second linear boundaries are independently laterally angled relative to the central lateral axis at an angle of between about 10° to about 30°.

3. The dispenser of claim 2 wherein the first and second linear boundaries are parallel to one another.

4. A tape strip dispenser, comprising a housing, wherein (a) the housing includes at least (i) transversely spaced top and bottom surfaces, (ii) longitudinally spaced first and second ends, and (iii) laterally spaced first and second sides; and (b) the housing defines (i) a retention chamber defining a longitudinal central axis and a lateral central axis, and (ii) a longitudinally centralized opening through the top with the opening longitudinally bounded along a first end by a first linear edge, and longitudinally bounded along a second end by a second liner edge wherein the first and second linear edges are laterally angled relative to the central lateral axis.

5. The dispenser of claim 4 wherein the first and second linear edges are independently laterally angled relative to the central lateral axis at an angle of between about 10° to about 30°.

6. The dispenser of claim 5 wherein the first and second linear edges are parallel to one another.

7. An article of commerce, comprising a tape strip dispenser and a tape strip pad, wherein:

(a) the dispenser has a top, a longitudinally centralized opening through the top, and an internal retention chamber accessible through the opening;

(b) the tape strip pad is retained within the retention chamber and defines a central lateral axis; and (c) the longitudinally centralized opening has longitudinally spaced first and second linear boundaries, which are laterally angled relative to the central lateral axis of the tape strip pad retained within the retention chamber.

8. The article of claim 7 wherein the first and second linear boundaries are independently laterally angled relative to the central lateral axis at an angle of between about 10° to about 30°.

9. The article of claim 8 wherein the first and second linear boundaries are parallel to one another.

10. An article of commerce comprising a tape strip dispenser and a tape strip pad, wherein:

(a) the dispenser includes at least (i) transversely spaced top and bottom surfaces, (ii) longitudinally spaced first and second ends, (iii) laterally spaced first and second sides, (iv) a retention chamber, and (v) a longitudinally centralized opening through the top with the opening longitudinally bounded along a first end by a first linear edge, and longitudinally bounded along a second end by a second liner edge;

(b) the tape strip pad is retained within the retention chamber and defines a central lateral axis; and (c) the first and second linear edges are laterally angled relative to the central lateral axis of the tape strip pad retained within the retention chamber.

11. The dispenser of claim 10 wherein the first and second linear edges are independently laterally angled relative to the central lateral axis at an angle of between about 10° to about 30°.

12. The dispenser of claim 11 wherein the first and second linear edges are parallel to one another.

13. A tape strip dispenser, comprising a housing, wherein (a) the housing includes at least (i) transversely spaced top and bottom surfaces, (ii) longitudinally spaced first and second ends, and (iii) laterally spaced first and second sides;

(b) the housing defines (i) a retention chamber, and (ii) a longitudinally centralized opening through the top with the opening longitudinally bounded along a first end by a first linear edge, and longitudinally bounded along a second end by a second liner edge; and (c) the first and second linear edges are independently pivotable about a first and a second lateral axis respectively.

14. The dispenser of claim 13 wherein:

(a) the first linear edge and the first lateral axis are longitudinally spaced a distance of between about 1 cm to about 4 cm; and (b) the second linear edge and the second lateral axis are longitudinally spaced a distance of between about 1 cm to about 4 cm.

15. A method of dispensing an overlying tape strip from a W-stacked pad of differential release tape strips, wherein (i) the pad defines a central lateral axis, (ii) the pad has sequential tape strips longitudinally reversed so as to align a first longitudinal end of each tape strip with a second longitudinally end of an immediately overlaying and an immediately underlying tape strip, and (iii) the pad includes at least (a) an overlying tape strip having a first longitudinal end and a second longitudinal end, (b) an intermediate tape strip immediately underneath the overlying tape strip and having a first longitudinal end and a second longitudinal end, and (c) an underlying tape strip immediately underneath the intermediate tape strip, sequentially comprising the steps of:

(1) pulling the second longitudinal end of the overlying tape strip away from the pad so as to effect peeling of the overlying tape strip from the intermediate tape strip in a progressive fashion from the second longitudinal end of the overlying tape strip towards the first longitudinal end of the overlying tape strip;

(2) contacting the overlying tape strip so as to consistently cause the overlying tape strip to release from the intermediate tape strip along a line of departure which is laterally angled relative to the central lateral axis of the pad prior to complete separation of the overlying tape strip from the intermediate tape strip and prior to release of a second longitudinal end section of the intermediate tape strip from the underlying tape strip; and (3) continuing to pull the overlying tape strip away from the pad to sequentially effect (i) release of the second longitudinal end section of the intermediate tape strip from the underlying tape strip, and (ii) complete separation of the overlying tape strip from the intermediate tape strip.

16. The dispensing method of claim 15 further comprising the step of supporting the second longitudinal end section of the intermediate tape strip released from the underlying tape strip above the pad so as to facilitate subsequent dispensing of the intermediate tape strip.

17. The dispensing method of claim 15 wherein the line of departure is laterally angled relative to the central lateral axis of the pad at an angle of between about 10° to about 30°.

18. The dispensing method of claim 15 wherein the overlying tape strip is contacted and forms a laterally angled line of departure with a longitudinal length of at least 1 cm of the overlying tape strip still adhered to the intermediate tape strip, wherein the longitudinal length is measured along a central longitudinal axis of the pad.

19. The dispensing method of claim 15 wherein the overlying tape strip is contacted and forms a laterally angled line of departure with a longitudinal length of at least 2 cm of the overlying tape strip still adhered to the intermediate tape strip, wherein the longitudinal length is measured along a central longitudinal axis of the pad.

20. A method of dispensing an overlying tape strip from a W-stacked pad of differential release tape strips retained within a dispenser, wherein (i) the pad defines a central lateral axis, (ii) the pad has sequential tape strips longitudinally reversed so as to align a first longitudinal end of each tape strip with a second longitudinally end of an immediately overlaying and an immediately underlying tape strip, (iii) the pad includes at least (a) an overlying tape strip having a first longitudinal end, a second longitudinal end and a lateral width, (b) an intermediate tape strip immediately underneath the overlying tape strip and having a first longitudinal end and a second longitudinal end, and (c) an underlying tape strip immediately underneath the intermediate tape strip, and (iv) the dispenser includes at least (a) transversely spaced top and bottom surfaces, (b) longitudinally spaced first and second ends, (c) laterally spaced first and second sides, (d) a retention chamber, and (e) a longitudinally centralized opening through the top with the opening longitudinally bounded along a first end by a first linear edge, and longitudinally bounded along a second end by a second liner edge, and (iv) the first and second linear edges are independently pivotable about a corresponding first and a second lateral axis, sequentially comprising the steps of:

(1) pulling the second longitudinal end of the overlying tape strip away from the pad so as to effect peeling of the overlying tape strip from the intermediate tape strip in a progressive fashion from the second longitudinal end of the overlying tape strip towards the first longitudinal end of the overlying tape strip;

(2) contacting the overlying tape strip across the lateral width of the overlying tape strip with one of the linear edges prior to complete separation of the overlying tape strip from the intermediate tape strip and prior to release of a second longitudinal end section of the intermediate tape strip from the underlying tape strip;

(3) continuing to pull the overlying tape strip away from the pad to sequentially effect (i) release of the second longitudinal end section of the intermediate tape strip from the underlying tape strip, and (ii) complete separation of the overlying tape strip from the intermediate tape strip; and (4) wherein the contacted liner edge pivots about the corresponding lateral axis away from the pad in concurrence with movement of the overlying tape strip during at least a portion of the continued pulling of the overlying tape strip away from the pad to effect release of the second longitudinal end section of the intermediate tape strip from the underlying tape strip.

21. The dispensing method of claim 20 wherein the contacted liner edge pivots in concurrence with movement of the overlying tape strip until the second longitudinal end section of the intermediate tape strip releases from the underlying tape strip.

* * * * *

UNITED STATES PATENT AND TRADEMARK OFFICE

CERTIFICATE OF CORRECTION

PATENT NO. : 6,648,173 B2
DATED : November 18, 2003
INVENTOR(S) : Crawford, Dennis L.

It is certified that error appears in the above-identified patent and that said Letters Patent is hereby corrected as shown below:

Title page,
Item [57], ABSTRACT,
Line 7, delete ";" after "(i)".

Signed and Sealed this

Thirtieth Day of November, 2004

JON W. DUDAS
*Director of the United States Patent and Trademark Office*